United States Patent [19]

Frómming et al.

[11] 4,430,822

[45] Feb. 14, 1984

[54] FIREARM, PARTICULARLY A RIFLE

[75] Inventors: Hans Frómming, Herrsching; Otto Repa, Oberndorf, both of Fed. Rep. of Germany

[73] Assignee: Carl Walther GmbH, Ulm, Fed. Rep. of Germany

[21] Appl. No.: 288,412

[22] Filed: Jul. 30, 1981

[51] Int. Cl.[3] ..... F41C 7/00; F41C 23/00

[52] U.S. Cl. ..... 42/71 R; 42/73

[58] Field of Search ..... 89/199, 185, 37 BA; 42/72, 73, 71 R, 1 ST

[56] References Cited

U.S. PATENT DOCUMENTS

| | | | |
|---|---|---|---|
| 1,386,247 | 8/1921 | Fordyce | 42/71 R X |
| 3,137,958 | 6/1964 | Lewis et al. | 42/73 |
| 3,999,461 | 12/1976 | Johnson et al. | 89/185 |
| 4,242,826 | 1/1981 | Anschütz | 42/73 |
| 4,327,626 | 5/1982 | McQueen | 42/72 |

FOREIGN PATENT DOCUMENTS

| | | | |
|---|---|---|---|
| 1289286 | 12/1962 | France | 42/1 ST |

*Primary Examiner*—Charles T. Jordan
*Assistant Examiner*—Ted L. Parr
*Attorney, Agent, or Firm*—Edmund M. Jaskiewicz

[57] ABSTRACT

The firearm has a rigid frame comprising a pair of vertically spaced substantially parallel hollow rods which are interconnected at their respective front and rear ends by vertical crosspieces. A barrel is mounted between the hollow rods and at the end of the barrel in the vicinity of the rearward end of the frame is a breech assembly which is interconnected to both the upper and lower rods. A shoulder support is mounted on the rear ends of the rods and positioned symmetrically with respect to the barrel. The shoulder support and other components of the firearm such as the pistol grip, front stock, rear stock and sight means are each individually and independently adjustable on the frame so as to conform to the physical characteristics of an individual shooter.

19 Claims, 19 Drawing Figures

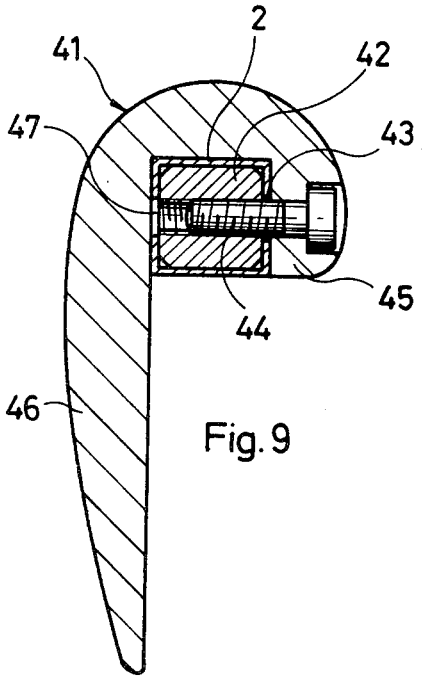
Fig. 9
Fig. 10
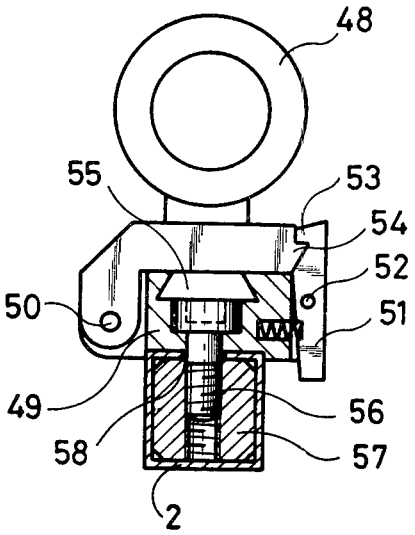
Fig. 12
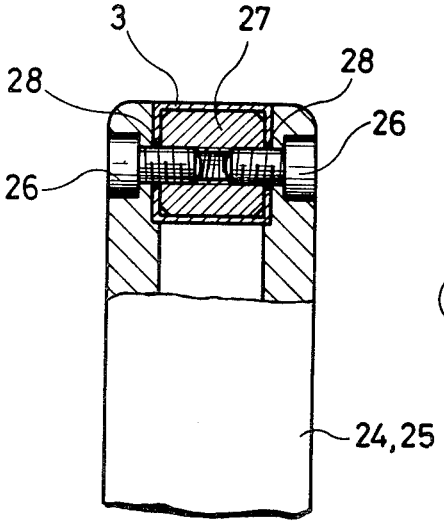
Fig. 11
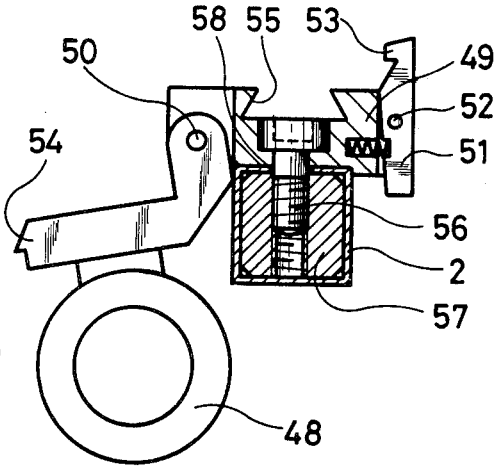

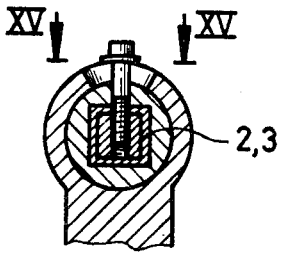
Fig. 14
Fig. 13
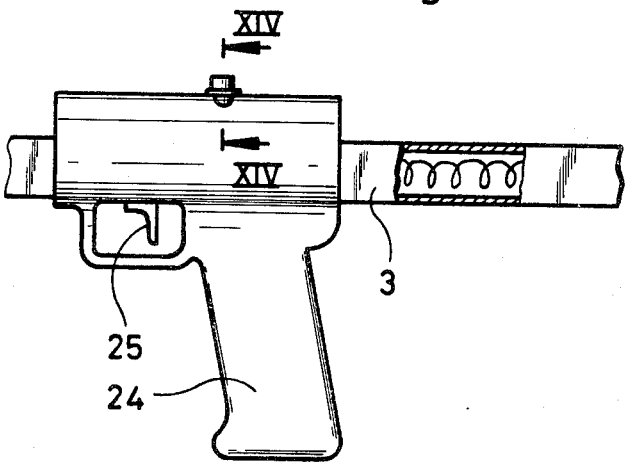
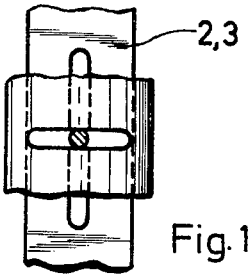
Fig. 15
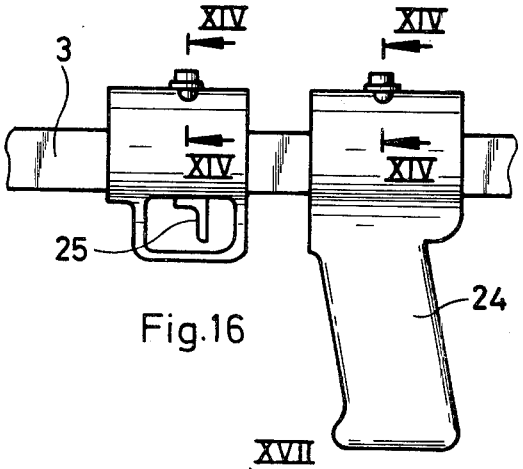
Fig. 16
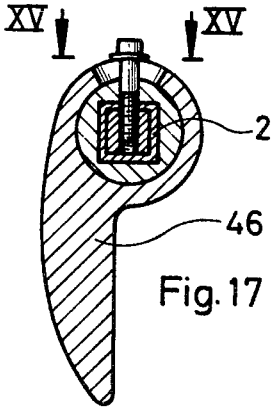
Fig. 17
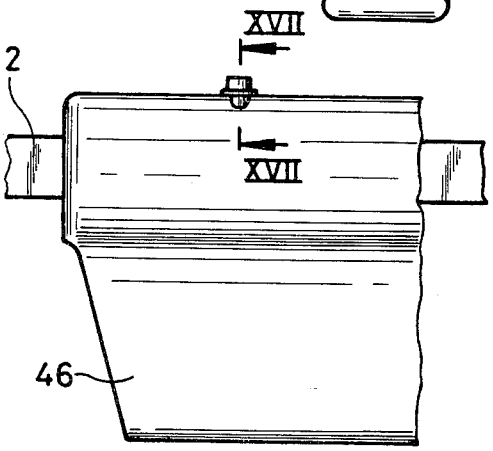
Fig. 18

FIREARM, PARTICULARLY A RIFLE

The present invention relates to a firearm such as a rifle which has a barrel fixed to a stock, more particularly to such a firearm having a frame upon which the barrel and other components of the firearm are adjustably mounted.

Firearms of this type are generally constructed by screwing or otherwise attaching the barrel to the breech assembly and the barrel and breech assembly are then secured with screws to a stock made of wood. This fastening and connection of the barrel and breech assembly to the wooden stock is satisfactory for normal firing conditions. However, in precision shooting, such as in competitive target shooting, it is very important that the connection between the barrel and breech assembly and the stock is absolutely firm and free from any strains. Because of the different coefficients of expansion of wood and steel deformations of the components can occur which influence the vibrations and oscillations of the entire firearm, and particularly of the barrel. Such deformations adversely affect the accuracy of the firearm. It has therefore been proposed that the wooden stocks of such firearms as were used in target shooting be cast integrally with a synthetic resin mass. It has also been proposed to utilize stocks which are completely made of fiberglass or of a light metal. The barrel and breech assembly were then connected by suitable adhesives to the fiberglass stock. Such integral assemblies had the disadvantage that it is not possible to disassemble components of the weapon without any damage to some component of the firearm because of its integral cast structure.

In spite of these various proposals, it has not been possible to achieve a stress-free connection between the barrel and stock of a firearm with the stock constructions and various fastening means which are presently known. Accordingly, it has not been possible to achieve the high degree of firing precision which has been desired and long sought for particular applications.

A further disadvantage of such known structures for connecting the barrel to the stock of a firearm is that only one side of the barrel is connected to the stock and this can result in disturbances to the functioning of the firearm and to undesired oscillations of the barrel derived from the actual firing.

It is therefore the principal object of the present invention to provide a novel and improved firearm, particularly of the rifle type.

It is another object of the present invention to provide such a firearm wherein the barrel is mounted between upper and lower parallel rods which define a frame.

It is a further object of the present invention to provide such a firearm which has a high degree of rigidity between its several components so as to provide a high degree of shooting accuracy.

It is an additional object of the present invention to provide a firearm capable of high precision firing and whose several components are readily adjustable to the particular physical conformation of the shooter.

It is still another object of the present invention to provide a high precision firearm whose components are readily accessible and can be readily manufactured at a reasonable cost.

According to one aspect of the present invention, a firearm may be provided which has a frame comprising a pair of substantially parallel rods normally disposed in vertically spaced relationship so as to define upper and lower rods and the ends of the rods are firmly connected together. A barrel is mounted between the upper and lower rods.

The rods are preferably hollow and the corresponding ends of the rods are rigidly interconnected by substantially vertically extending cross pieces. A shoulder support is mounted at the rear ends of the rods so as to be symmetrically disposed with respect to the barrel. Other components of the firearm including a pistol grip, a trigger device, a front stock, a rear stock and a sight means are adjustably mounted on one of the upper or lower rods.

Other objects and advantages of the present invention will be apparent upon reference to the accompanying description when taking in conjunction with the following drawings, which are exemplary, wherein;

FIG. 9 is a sectional view taken along the line IX—IX in FIG. 1;

FIG. 10 is a sectional view taken along the line X—X in FIG. 1;

FIG. 11 is a sectional view similar to that of FIG. 10 but showing the telescope sight in an outwardly pivoted position;

FIG. 12 is a sectional view taken along the line XII—XII in FIG. 1;

FIG. 13 is a side elevational view of a portion of FIG. 1 showing the piston grip on the lower rod;

FIG. 14 is a sectional view taken along the lines XIV≦XIV of FIG. 13;

FIG. 15 is a top plane view of FIG. 14 in the direction as indicated by the arrows XV—XV;

FIG. 16 is a side elevational view similar to that of FIG. 13 but showing a trigger slidably and pivotably mounted on the lower rod of the frame;

FIG. 17 is a sectional view taken along the line XVII—XVII of FIG. 18;

FIG. 18 is a side elevational view of a second shank mounted on the upper rod so as to form the rear stock proper;

Proceeding next to the drawings wherein like reference symbols indicate the same parts throughout the various views a specific embodiment and modifications of the present invention will be described in detail.

Figure 1:
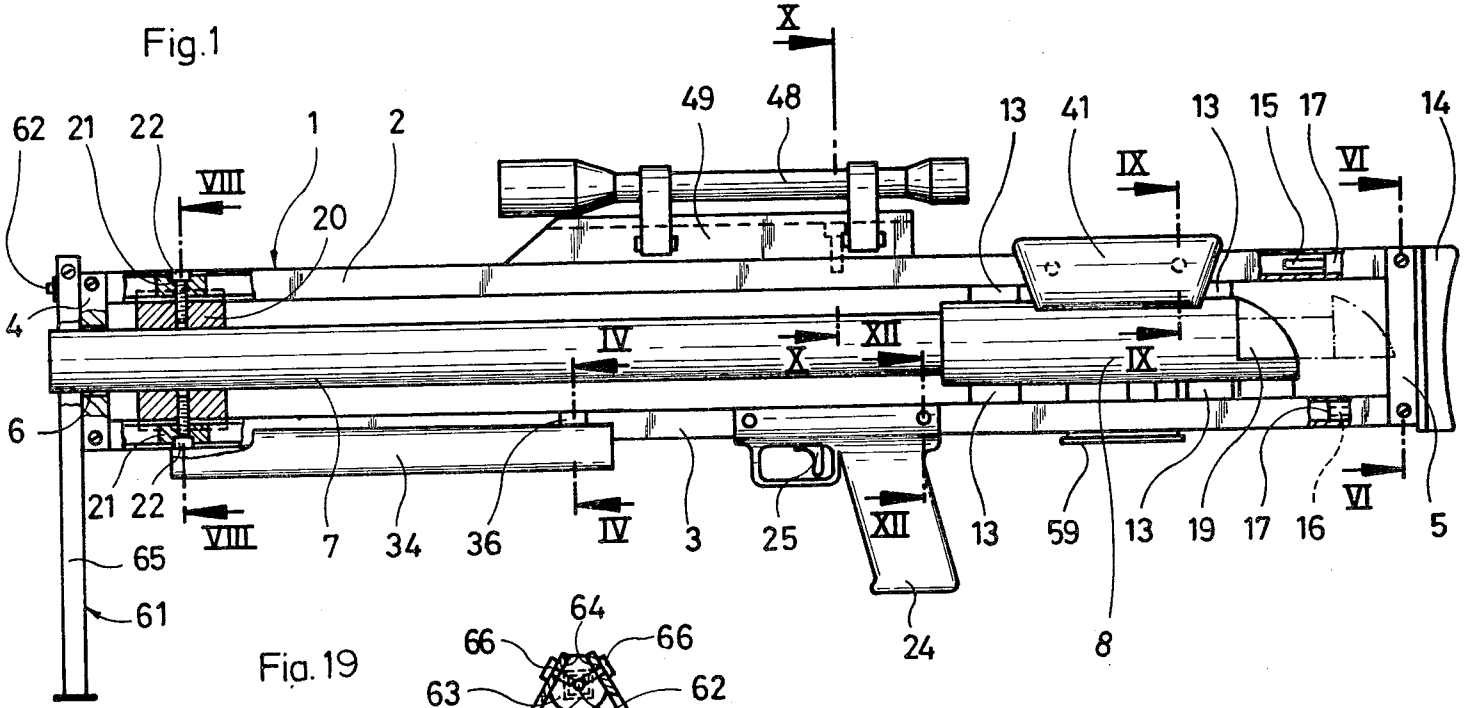
FIG. 1 is a side elevational view of the firearm according to the present invention with portions thereof being shown in section.
Figure 19:
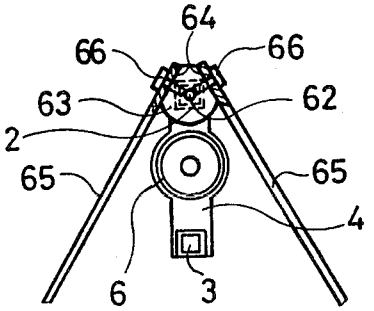
FIG. 19 is a front elevational view of the firearm of FIG. 1 showing the support legs.

In FIG. 1 there is shown a high precision rifle the stock of which is formed by a frame indicated generally at 1 which consists of an upper rod 2 and a lower rod 3, each of which are tubular and have square cross sections. The rods are of the type known as profile elements and the cross section may also be circular or combined square and circular.

The front ends of the rods 2 and 3 are firmly interconnected by a web of substantially vertically arranged cross piece 4 and in a similar manner the rear ends of the rods 2 and 3 are rigidly interconnected by a cross piece 5. The front cross piece 4 has a bore 6 through which a barrel 7 of the firearm passes without contact with the cross piece. The barrel 7 can thus oscillate or vibrate freely as a result of the firing impulse and any bouncing or vibration of the barrel resulting from contact of the barrel with the frame which adversely affects firing accuracy is thereby avoided.

The frame 1 is normally disposed in a vertical position such as shown in the drawing and the upper rod 2 is thus vertically spaced from the lower rod 3. According to the present invention, the frame need not be precisely vertical but may be tilted or pivoted to a substantial angle on either side of the vertical position.

Figure 2:
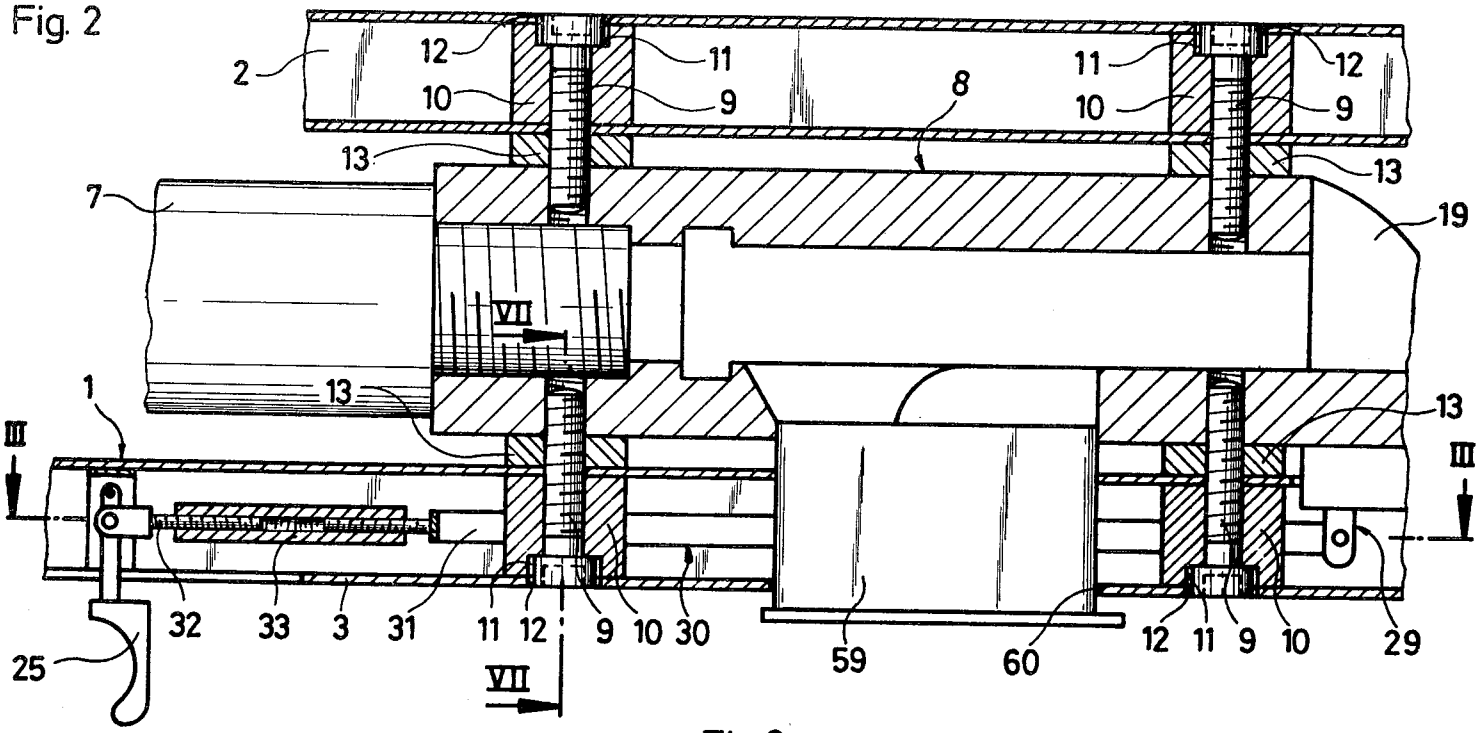
FIG. 2 is a vertical sectional view in enlarged scale of a portion of the firearm in FIG. 1 including the breech assembly.
Figure 3:
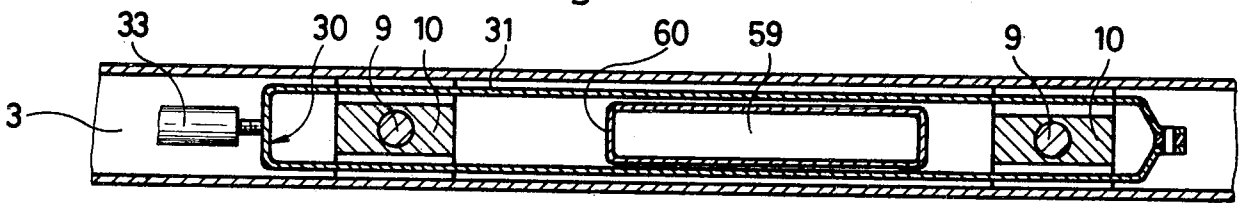
FIG. 3 is a section view taken along the line III—III in FIG. 2.

A breech assembly 8 is mounted centrally between the upper and lower rods 2 and 3 and includes the breech elements and the firing release mechanism of the weapon as may be seen in FIGS. 1, 2 and 3. The barrel 7 is screwed securely into the breech assembly 8 in a manner as known in the art or attached in some other suitable way. The breech assembly 8 is attached to the upper and lower rods 2 and 3 by threaded screws 9 which pass through the rods 2 and 3 and are threaded into corresponding threaded bores in the breech assembly 8. Filler blocks 10 are positioned within the interiors of the rods 2 and 3 as shown in FIG. 2 and have bores therethrough to receive the threaded screws 9. The filler blocks are each provided with recesses 11 into which are seated the heads of the screws 9 so that the outer surfaces of the screw heads are flush with the outer surfaces of the rods 2 and 3 to provide a smooth surface. The rods 2 and 3 are provided with bores 12 which are of sufficient size to accommodate the heads of these screws and may correspond in diameter to the recesses 11. Spacer blocks 13 are positioned between the breech assembly 8 and the respective upper and lower rods 2 and 3 and the screws 9 pass through bores in the spacer blocks 13 as shown in FIG. 2.

The frame structure 1 formed by the profile rods 2 and 3 and the cross pieces 4 and 5 has a high degree of rigidity and insures a stress-free mounting of the breech assembly 8 to the rods 2 and 3. A uniform distribution of forces from the barrel 7 to the frame 1 is achieved by the symmetrical positioning of the barrel 7 with respect to the rods 2 and 3 of the frame.

A shoulder support 14 is mounted at the rear end of the frame 1 and is positioned symmetrically with respect to the barrel 7. This symmetrical arrangement enables the recoil forces to be transmitted linearly upon firing and thus torque on the firearm is avoided.

Figure 6:
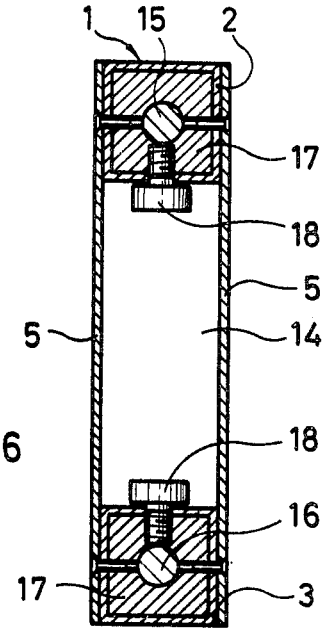
FIG. 6 is a sectional view taken along the line VI—VI in FIG. 1.

The shoulder support is detachably connected to the frame 1 by means of upper and lower pins 15 and 16 which are inserted in bores formed in filler block 17 which are securely inserted into the ends of the rods 2 and 3. The pins 15 and 16 are thus introduced to the bores in the block 17 which are parallel to the longitudinal axes of the rods 2 and 3. Set screws 18 are provided in the blocks 17 to exert a tightening force against the pins 15 and 16 as shown in FIG. 6. The shoulder support 14 is thus longitudinally displaceable in the block 17 and can be secured in a desired adjusted longitudinal position by means of the set screws 18.

In order to avoid completely removing the shoulder support 14 in order to permit access from the rear to the components of the firearm within the frame 1, the upper pin 15 is longer than the lower pin 16 as shown in FIG. 1. As a result, the shoulder support 14 can be displaced rearwardly from the rods 2 and 3 until the lower pin 16 is free of its filler block 17. The shoulder support 14 can thus be pivoted laterally or to an upward position about the pivot axis defined by the upper pin 15.

As a modification, the shoulder support 14 can be constructed so as to be pivotable upwardly or downwardly about an axis positioned transversely of the firing direction of the firearm and arranged on either the upper rod 2 or lower rod 3. Suitable fasting means are also provided so that after the shoulder support is pivoted back into its normal position as shown in FIG. 1 the free end of the shoulder support can be attached to its respective rod 2 or 3.

In order to reduce the overall length of the firearm while utilizing a constant length barrel, the breech assembly 8 which is attached to the barrel 7 is positioned in the rearward portion of the frame 1 as shown in FIG. 1. The breech assembly 8 is positioned as close to the rear end of the frame 1 as possible to enable breech 19 to be pulled back to a position directly in front of the shoulder support 14 when in its fully opened position as shown by the dashed lines in FIG. 1. This rearward positioning of the breech assembly 8 also improves the firing precision of the firearm since the distance from the muzzle of the barrel to the support point of the firearm with respect to the body of the user is reduced.

Figure 8:
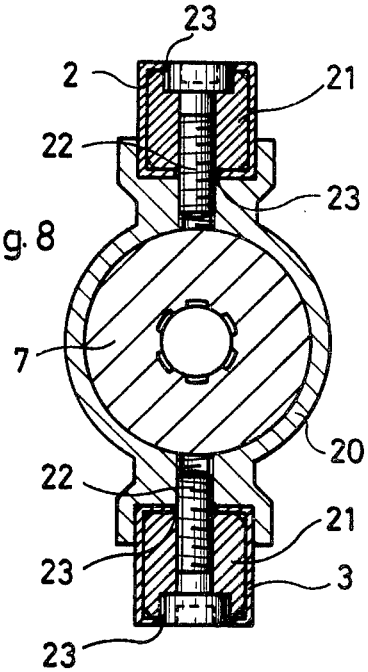
FIG. 8 is a sectional view taken along the line VIII—VIII in FIG. 1.

In order to reduce any oscillations of the barrel which may be caused by the firing impulse, a guide bushing 20 is closely fitting around the front portion of the barrel but still permitting axial movement of the barrel and the bushing is attached to the upper and lower rods 2 and 3 as may be seen in FIGS. 1 and 8. This construction enables the barrel 7 to expand thermally in the axial direction while at the same time the barrel is fixed by the guide bushing 20 against any movement radially. The guide bushing 20 is longitudinally displaceable and can be fixed along different positions of the rods 2 and 3 in order to be able to locate the bushing 20 in that region of the barrel which is susceptible to the greatest magnitude of oscillation. The region of greatest oscillation will vary between firearms. In order to attach the guide bushing to the rods 2 and 3, filler blocks 21 are positioned within the rods 2 and 3 and threaded screws 22 pass through bores in the rods 2 and 3 and filler blocks 21 to engage correspondingly threaded bores in the bushing 20. The screws 22 are received within openings 23 formed in the walls of the rods 2 and 3 and these openings are preferably slots to permit longitudinal displacements of the guide bushing 20 along the rods 2 and 3 after loosening of the threaded screws 22. The bushing 20 is then fixed in its desired position by tightening the threaded screws 22.

A pistol grip 24 having a trigger 25 is mounted for longitudinal displacement on the lower rod 3 in order to provide a further adjustment of the firearm to the physical conformation of the user. The pistol grip 24 which also includes the trigger 25 can be adjusted in a desired position on the rod 3 by loosening and then tightening of threaded screws 26 as seen in FIGS. 1 and 12. A filler block 27 which is movable axially within the lower rod 3 has threaded bores which receive the ends of the screws 26 passing through the laterally disposed slots 28 in the side walls of the lower rod 3. Corresponding bores for seating of the threaded screws 26 as well as recesses for the screw head are provided in the sidewalls of the pistol grip 24. After loosening of the screws 26, the pistol grip 24 together with the trigger 25, the screws 26 and the filler block 27 can be displaced longitudinally with respect to the lower rod 3 and adjusted into a position corresponding to the length of the users arm.

In order to readily accommodate any tilting of the firearm because of inclination of the line of sight toward the eye of the shooter, the pistol grip 24 together with the trigger 25 can be constructed so as to be pivotable about the longitudinal axis of the lower rod 3 or about an axis which is parallel to the lower rod. The pistol grip 24 can thus be fixed in a desired angular position. The same construction used for pivoting displacement of the front stock as illustrated in FIG. 4 may be used for the pivotable mounting of the pistol grip 24.

An additional adjustment in order to more closely position the components of the firearm with respect to the physical conformation of the shooter can be achieved by constructing the pistol grip 24 separate and independent from the trigger device 25 so that these two components are longitudinally displaceable independently of each other. Physical characteristics such as the length of the trigger finger and the size of the hand of different users of the firearm can thus be readily accommodated. In this modification also, the pistol grip 24 can be constructed for pivotal movement about the longitudinal axis of the lower rod 3 or about an axis parallel to the lower rod 3 and subsequently fixing the pistol grip in the desired angular position.

Figure 7:
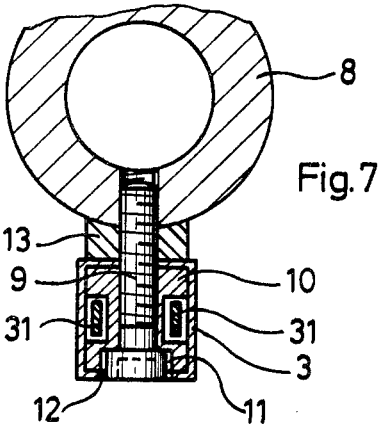
FIG. 7 is a sectional view taken along the line VII—VII in FIG. 1.

The variations in length between the firing release mechanism 29 in the breech assembly 8 and the trigger 25 resulting from longitudinal displacement of the trigger 25 is compensated by providing a two-part threaded operating rod 30 the length of which can be varied between the trigger device 25 and the firing release mechanism 29 and seen in FIGS. 2 and 3. The operating rod 30 comprises two rod portions 31 and 32 connected together by a turn buckle 33 which has a right-hand and a left-hand internal thread so that the length of the operating rod 30 can be adjusted by rotation of the turn buckle 33 in the proper direction. The operating rod 30 is positioned within the lower rod 3 in order to be protected from damage and dirt. Rod portion 31 of the operating rod 30 is bifurcated in the region of the breech assembly so that the bifurcated portions will be passed laterally of the screws 9 and within recesses formed in the filler blocks 10 as shown in FIGS. 3 and 7.

Figure 4:
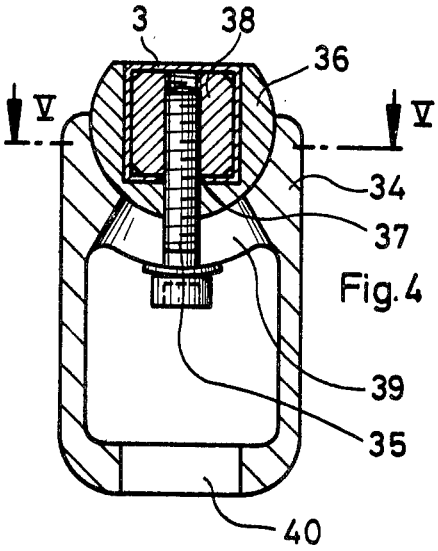
FIG. 4 is a sectional view taken along the line IV—IV in FIG. 1.
Figure 5:
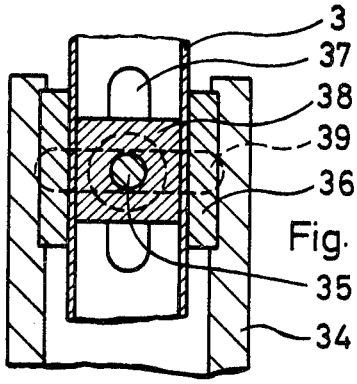
FIG. 5 is a sectional view taken along the line V—V in FIG. 4.

In order to further adjust the firearm to accommodate different arm lengths of users, a front stock 34 is mounted for longitudinal displacement on the lower rod 3 of the frame 1 as shown in FIGS. 1, 4 and 5. The front stock is mounted on the lower rod 3 by a threaded screw 35 carried in a slide element 36 which is displaceable on the outer surface of the lower rod 3. A screw 35 passes through a longitudinally extending slot 37 in the lower wall of the rod 3 and engages a correspondingly threaded bore of a filler block 38 positioned within the rod 3 and longitudinally moveable therein. The screw 35 passes through a transversely extending slot 39 in the front stock 34. The lower region of the sliding piece 36 and the upper region of the front stock 34 are cylindrical in shape so that the front stock 33 is pivotable about the convex contour of the slide piece 36. The slide piece 36 is mounted on the front stock 34 so as to be nondisplaceable in the longitudinal direction with respect to the front stock as shown in FIG. 5. The screw 35 is accessible through an opening 40 formed in the underside of the front stock 34 and shown in FIG. 4. When the screw 35 is loosened, the front stock together with the slide piece 36 can be longitudinally displaced on the lower rod 3 and at the same time the front stock 34 can be pivoted about the outer cylindrical surface of the slide piece 36. This construction thus accommodates different arm lengths of the users and also any tilting of the firearm from its vertical position in order to provide a more comfortable positioning of the firearm with respect to the shooter. This described construction for mounting of the front stock 34 is preferably provided at both the front and rear ends of the front stock.

The firearm is also provided with a rear stock 41 against which the jaw of the shooter rests when sighting the firearm. This rear stock 41 can also be positioned to accommodate physical characteristics of the shooter. The rear stock 41 is mounted on the upper rod 2 in the rearward region of the frame 1 as may be seen in FIG. 1 and is longitudinally displaceable along the upper rod 2 and can be fixed in an adjusted position. Mounting of the rear stock 41 is achieved by providing a filler block 42 within the upper rod 2 and the block 42 is moveable longitudinally within the rod. A threaded screw 44 passes through a slot 43 extending longitudinally in a side wall of the rod 2 and engages in a corresponding threaded bore of the filler block 42. The screw 44 is seated in a shank 45 of the rear stock 41 which is opposite a second shank 46 which forms the rear stock proper.

The firearm can be readily shifted over from right hand to left hand use and visa versa by changing the mounting of the rear stock 41 to the other side of the rod 2. For this purpose there is similarly provided in the left side wall of the rod 2 a longitudinally extending slot 47 which is aligned with the slot 43 and through which the screw 44 passes when the rear stock is mounted on the other side of the rod 2 or in the left hand mode.

A telescope sight 48 is longitudinally displaceable and capable of being fixed in position on the upper rod 2 as seen in FIGS. 1, 10 and 11. The telescope sight 48 is mounted upon a base plate 49 and is pivotable about the shaft or pin 50 arranged laterally on the base plate 49 and extending in the firing direction or longitudinally with respect to the firearm. A retaining pawl 51 is pivotable about a pin 52 extending in the longitudinal direction on the side of the base plate opposite the pin 50. The pawl 51 is resiliently biased and has a latch portion 53 which engages behind a projection 54 of the telescope 48 to retain the telescope 48 in its normal position as shown in FIG. 10. By depressing the pawl 51 against the force of the spring the telescope sight is released and can be pivoted laterally and downwardly about the pin 50 into the position as shown in FIG. 11. The base plate 49 which is preferably provided with a dovetail guide 55 can now have mounted thereon other sighting equipment such as mechanical sights or night sights.

The base plate 49 is attached to the upper rod 2 by two threaded screws 56 which pass through a longitudinal slot 58 in the upper wall of the rod 2 to engage correspondingly threaded bores in a filler block 57 longitudinally displaceable within the rod 2. By loosening the screws 56, the base plate 49 together with the telescope sight 48, the screws 56 and the filler block 57 can be displaced longitudinally with respect to the rod 2 in order to position the sighting device at the desired and comfortable distance from the eye of the shooter.

The firearm according to the present invention can also be modified by providing an electrical trigger for firing a shot. For protection from damage and dirt, the suitable electrical conductors between the trigger device 25 and the firing release mechanism 29 are preferably located with the lower rod 3.

In order to accommodate a magazine 59, the lower rod 3 is provided with a longitudinally extending recess 60 behind the pistol grip 24 as may be seen in FIGS. 1, 2 and 3. The magazine 59 is introduced upwardly through the rod 3 between the bifurcated portions of the operating rod element 31.

In order to support the firearm, there are provided two support legs 61 which are attached to the upper rod 2 of the frame 1 as may be seen in FIGS. 1 and 13. A bushing 63 is pivotably mounted on a pin or bolt 62 extending longitudinally from the upper rod 2. The bushing 63 has two beveled surfaces 64 against which support legs 65 abut. The beveled surfaces 64 diverge outwardly from the upper rod 2 as may be seen in FIG. 13 and are parallel to the longitudinal axis of the mounting bolt 62. The support legs 65 are each pivotably attached to the bushing 63 with mounting screws 66. Thus, loosening of the screws 66 will enable the support legs 65 to be pivoted upwardly into positions parallel to the longitudinal axis of the firearm along both sides of the upper rod 2.

The pivot axis 62 of the two support legs 61 is positioned above a horizontal line extending through the center of gravity of the firearm. Thus, when the support legs 61 are pivoted to their support positions as shown in FIGS. 1 and 13 and when the ground is uneven or sloping the firearm can be moved by the shooter in the manner of a pendulum into the vertical position and can thus be precisely aligned for the most favorable shooting position with respect to the mounting bolt 62.

Thus it can be seen that the present invention has disclosed a firearm which permits higher precision and greater accuracy in firing. The firearm also has a number of components which are capable of being moved to various positions and adjusted into these positions which accommodate and thus closely conform to the physical characteristics and anatomical features of the shooter. A single firearm can thus be in effect a custom-built weapon for a particular shooter. The mounting of the barrel and breech mechanism centrally between two longitudinally extending components of a frame insures that recoil forces are transmitted linearly and torque forces resulting from firing are avoided. The frame of the present firearm thus corresponds to the stock of conventional firearms particularly rifles known at the present time but eliminates most of the disadvantages associated with such conventional rifles which interfere with high precision firing.

It will be understood that this invention is susceptible to modification in order to adapt it to different usages and conditions, and accordingly, it is desired to comprehend such modifications within this invention as may fall within the scope of the appended claims.

What is claimed is:

1. In a firearm, particularly a rifle a frame comprising a pair of substantially parallel rods normally disposed in vertically spaced relationship to define an upper rod and a lower rod and means for firmly connecting said rods together, said rods each have a front end and a rear end, a shoulder support detachably connected to the rear ends of said rods, a breech assembly fastened between said rods adjacent the rearward end of said frame such that when a breech lock mechanism of the assembly is fully opened the mechanism is positioned immediately in front of said shoulder support, and a barrel between said upper and lower rods and attached to said breech assembly, longitudinally adjustable means on said frame for controlling oscillation of the barrel during firing, said rod connecting means comprises a substantially vertical first crosspiece connecting said front ends of said rods, said first crosspiece having an opening therein and said barrel extending through said opening without contact with said first crosspiece and a second crosspiece connecting the rear ends of said rods.

2. In a firearm as claimed in claim 1 wherein said rods each comprise a tubular element and has a plurality of pairs of aligned first bores therein, said breech assembly disposed between said tubular elements, filler blocks in each of said tubular elements and having second bores therethrough, screws passing through said first and second bores and threaded into said breech assembly to fasten said assembly in position between said rods, said screws having their heads recessed in said tubular elements and filler blocks.

3. In a firearm as claimed in claim 2 and further comprising a pistol grip including a trigger slideably and pivotably mounted on said lower rod of said frame, said breech assembly having a firing release mechanism, an operating rod disposed substantially parallel to said frame operatively connecting said trigger and said firing release mechanism, said operating rod being bifurcated into two parallel rod members in the vicinity of said breech assembly, said parallel rod members passing laterally of said screws and through openings in said filler blocks.

4. In a firearm as claimed in claim 3 and further comprising said lower rod having an opening therein between said pistol grip and the rear ends of said rods through which a magazine can be passed, a said magazine being introduced between said parallel bifurcated operating rod members.

5. In a firearm as claimed in claim 1 and said oscillation controlling means comprising a guide bushing surrounding said barrel between the forward end of said frame and said breech assembly, and means for connecting said bushing to said upper and lower rods such that said bushing is longitudinally displaceable on said rods.

6. In a firearm as claimed in claim 1 and further comprising a pistol grip including a trigger slideably and pivotably mounted on said lower rod of said frame.

7. In a firearm as claimed in claim 6 and further comprising a firing release mechanism on said breech assembly, and an operating rod disposed substantially parallel to said frame operatively connecting such trigger and said firing release mechanism.

8. In a firearm as claimed in claim 7 wherein said operating rod comprises first and second rod portions interconnected by a turnbuckle such that the length of said operating rod is variable.

9. In a firearm as claimed in claim 8 wherein said rods are hollow and said operating rod is disposed within said lower rod.

10. In a firearm as claimed in claim 6 wherein said lower rod has an opening therein between said pistol grip and the rear ends of said rods through which a magazine can be passed.

11. In a firearm as claimed in claim 6 wherein said trigger actuates an electrical trigger device.

12. In a firearm as claimed in claim 11 wherein said rods each comprise a tubular element, said breech assembly having a firing release mechanism, and electrical conductors connected between said trigger device and said firing release mechanism and being disposed within said lower rod.

13. In a firearm as claimed in claim 1 and further comprising a pistol grip slideably and pivotably mounted on lower rod of said frame, and a trigger unit slideably and pivotably mounted on said lower rod of said frame independently of said pistol grip.

14. In a firearm as claimed in claim 1 and further comprising a front stock longitudinally displaceable and pivotable upon said lower rod into an adjusted position, and means for fastening said front stock in a said adjusted position.

15. In a firearm as claimed in claim 1 and further comprising a rear stock longitudinally displaceable and pivotable upon said upper rod into an adjusted position, and means for fastening said rear stock in a said adjusted position.

16. In a firearm as claimed in claim 1 and further comprising sight means longitudinally displaceable and pivotable upon said upper rod into an adjusted position, and means for fastening said sight means in a said adjusted position.

17. In a firearm as claimed in claim 16 wherein said sight means is pivotably mounted on said upper bar by a pin such that said sight means is pivotable out of the line of sight.

18. In a firearm as claimed in claim 1 and further comprising firearm support means pivotably mounted on said frame and having a pivot axis parallel to said barrel and above the center of gravity of the firearm in the forward portion of said frame.

19. In a firearm as claimed in claim 18 wherein said pivot axis comprises a pin attached to the forward end of said upper rod, said support means comprising a pair of legs diverging from said pivot axis.

* * * * *